US011466545B2

(12) United States Patent
Glaser et al.

(10) Patent No.: US 11,466,545 B2
(45) Date of Patent: Oct. 11, 2022

(54) GUIDE SUB FOR MULTILATERAL JUNCTION

(71) Applicant: Halliburton Energy Services, Inc., Houston, TX (US)

(72) Inventors: Mark Christopher Glaser, Houston, TX (US); Angus Mackay Barron, Alford (GB); Michael Linley Fripp, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 13 days.

(21) Appl. No.: 17/187,394

(22) Filed: Feb. 26, 2021

(65) Prior Publication Data

US 2022/0275709 A1 Sep. 1, 2022

(51) Int. Cl.

| | |
|---|---|
| ***E21B 41/00*** | (2006.01) |
| ***E21B 17/14*** | (2006.01) |
| ***E21B 23/10*** | (2006.01) |

(52) U.S. Cl.

CPC ..... *E21B 41/0035* (2013.01); *E21B 17/14* (2013.01); *E21B 23/10* (2013.01); *E21B 2200/08* (2020.05)

(58) Field of Classification Search

CPC ..... E21B 41/0035; E21B 17/14; E21B 23/10; E21B 2200/08

See application file for complete search history.

(56) References Cited

U.S. PATENT DOCUMENTS

| | | | | |
|---|---|---|---|---|
| 3,526,280 | A * | 9/1970 | Aulick | E21B 33/14 166/381 |
| 5,150,756 | A | 9/1992 | Hassanzadeh | |
| 5,456,317 | A | 10/1995 | Hood, III et al. | |
| 6,443,244 | B1 | 9/2002 | Collins | |
| 6,591,903 | B2 * | 7/2003 | Ingle | E21B 43/305 166/50 |
| 7,789,162 | B2 | 9/2010 | Keller et al. | |
| 10,087,736 | B1 * | 10/2018 | Al-Mulhem | E21B 43/267 |
| 10,458,197 | B2 | 10/2019 | Khatiwada et al. | |

(Continued)

FOREIGN PATENT DOCUMENTS

WO 2014-198887 12/2014

OTHER PUBLICATIONS

International Search Report and Written Opinion for Application No. PCT/US2021/021828, dated Nov. 8, 2021.

*Primary Examiner* — Jonathan Malikasim

(74) *Attorney, Agent, or Firm* — Scott Richardson; C. Tumey Law Group PLLC

(57) ABSTRACT

In one or more examples, a method comprises advancing a tubing string along a primary wellbore toward a junction having a low-side exit to a secondary wellbore, with a guide sub positioned at a leading end of the tubing string. The guide sub has a buoyancy within a well fluid external to the guide sub. The buoyancy of the guide sub is used to bias the guide sub toward a high-side of the primary wellbore while moving the guide sub across the low-side exit to a downstream portion of the primary wellbore. Subsequently, the guide sub is used to guide a fluid or tubular component between the tubing string and the downstream portion of the primary wellbore across the low-side exit.

18 Claims, 5 Drawing Sheets

(56) References Cited

U.S. PATENT DOCUMENTS

| | | | | |
|---|---|---|---|---|
| 2003/0034156 | A1* | 2/2003 | Gondouin | E21B 7/065 166/117.5 |
| 2003/0192699 | A1 | 10/2003 | Gano | |
| 2008/0014812 | A1 | 1/2008 | Quigley et al. | |
| 2016/0145956 | A1 | 5/2016 | Dahl et al. | |
| 2016/0258227 | A1 | 9/2016 | Vemuri | |
| 2016/0273312 | A1 | 9/2016 | Steele et al. | |
| 2019/0186222 | A1* | 6/2019 | Steele | E21B 33/12 |
| 2019/0352994 | A1 | 11/2019 | Giroux | |
| 2020/0240214 | A1 | 7/2020 | Getzlaf et al. | |

* cited by examiner

GUIDE SUB FOR MULTILATERAL JUNCTION

BACKGROUND

A typical hydrocarbon well is formed by drilling a wellbore using a rotary drill bit at the end of a drill string. The drill string is progressively assembled by adding segments of tubing at the surface of the wellsite until a desired depth is reached. The wellbore may be drilled along any desired wellbore path with the use of a directional drilling system. The well may therefore include one or more vertical, horizontal, or otherwise deviated borehole sections, to reach a target formation. For example, a well may be drilled with a long, vertical section extending from the surface of the wellsite to a certain vertical depth, before angling sideways to reach the target formation. The drill string may be retrieved, and portions of the wellbore may be reinforced with a metallic casing string cemented in place downhole.

A multilateral well is a well formed with one or more lateral wellbores that branch off another wellbore. To construct a multilateral well, a first wellbore is drilled, and a casing joint is installed at the desired junction location. A deflector is then positioned at the desired junction location along the first wellbore and anchored in place. The deflector is used to guide the milling of a window through the casing of the first wellbore, and to subsequently guide a drill bit through the window to drill the lateral wellbore. The result is a multilateral junction where the two wellbores intersect. The multilateral junction can be reinforced, and the lateral wellbore may be completed for production of hydrocarbons through the lateral wellbore.

BRIEF DESCRIPTION OF THE DRAWINGS

These drawings illustrate certain aspects of some of the embodiments of the present disclosure and should not be used to limit or define the method.

DETAILED DESCRIPTION

The present disclosure is directed to systems and methods for navigating a multilateral wellbore in the vicinity of a multilateral junction. More specifically, the disclosure addresses the challenges of traversing a multilateral junction that has a low-side exit from a primary bore to a lateral bore. Conventionally, the weight of a conventional tubing string would cause the tubing string to veer into the low side exit when attempting to traverse the multilateral junction. One aspect of this disclosure is a buoyant guide sub configured to guide the tubing string across the low-side exit so that the downstream portion of the primary bore remains accessible.

The guide sub may be tripped downhole on a tubing string. The buoyancy of the guide sub is used to bias the guide sub toward a high-side of the primary bore while traversing the multilateral junction, to avoid veering out of the low-side exit into the lateral bore. Once the guide sub has been landed in the downstream portion of the primary bore, the guide sub may be used to guide the rest of the tubular string or a tubular component thereof across the junction. Alternatively, the guide sub may remain in place to serve as a floating conduit for service work in the downstream portion of the main wellbore. With the disclosed systems and methods, the lateral wellbore and the downstream portion of the existing, primary bore therefore remain navigable and serviceable.

A variety of example configurations and features are discussed. Generally, the guide sub may comprise a long tube formed of low-density materials, such as composite tubing. The guide sub may be capped at each end to form a sealed chamber filled with a gas. The gas may be pressurized to offset hydrostatic pressure downhole. The gas may be pre-pressurized above ground, or downhole using a floating piston or other pressure source. The guide sub may also be reinforced with a structural webbing, hollow glass microspheres, a rigid foam core, or a combination thereof. The low-density materials used in the guide sub provide buoyancy to the guide sub while traveling through a well fluid in the vicinity of the multilateral junction. The guide sub may also be formed of dissolvable materials, and/or the ends of the sealed chamber may be burst by applied pressure or drilled to provide through-tube access for subsequent delivery of fluids or tubular components.

Figure 1:
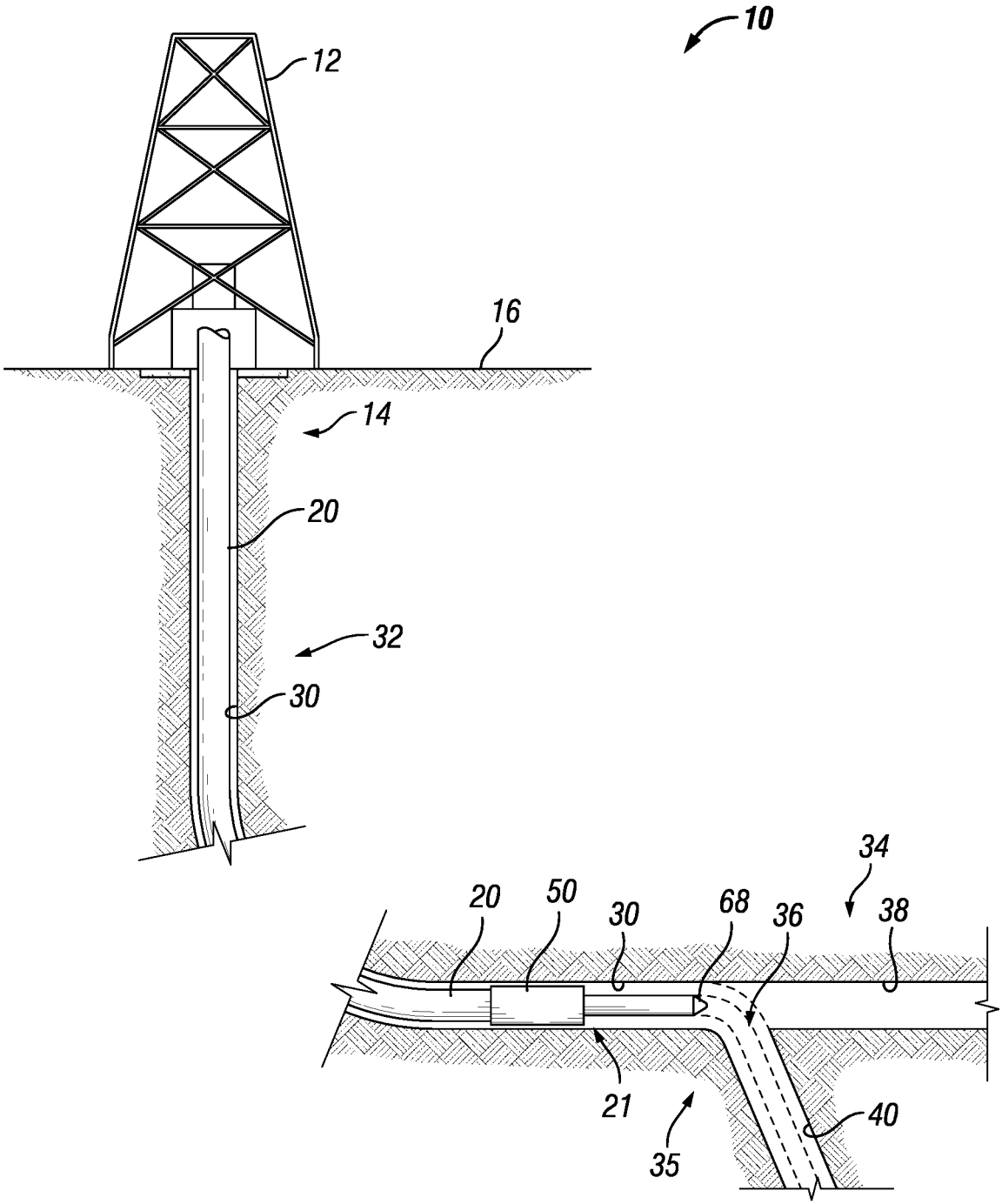
FIG. 1 is an elevation view of an example well site 10 for implementing aspects of this disclosure.

FIG. 1 is an elevation view of an example well site 10 for implementing aspects of this disclosure. A large support structure generally referred to as a rig 12 may be used for suspending and lowering a tubing string 20 into a multilateral well 14. Although the rig 12 is depicted as being land-based, the disclosed principles could be applied in a multilateral well at any other well site, such as an offshore or floating platform. The tubing string 20 may be assembled from individual tubing segments and tools as it is progressively lowered into the well 14, in which case equipment would be included for helping to make up and break out those connections. The rig 12 may alternatively support coiled tubing operations that use a long, continuous supply of tubing rather than assembling and disassembling the tubing string 20 from discrete segments. Various other equipment known in the art is provided at the well site 10 for supporting well operations such as the delivery or return of fluids, power, and electrical communication downhole.

The multilateral well 14 includes a main wellbore 30 drilled from a surface 16 of the wellsite 10 and at least one lateral wellbore 40 branching off the main bore 30, which together form a multilateral junction 35 in the drilled formation. The term "primary bore" is broadly used herein to refer to any wellbore intersected by another wellbore (the lateral or "secondary bore"). In this example, the main bore 30 is the primary bore of this multilateral junction 35 and the lateral bore 40 is the secondary bore of the multilateral junction 35. However, the disclosed principles are applicable to any multilateral junction, and is not limited to those involving the main bore drilled from surface.

The wellbore may follow a given wellbore path. In the FIG. 1 example, the first portion of the main bore 30 is a long, vertical section 32 drilled from a surface 16 of the well site 10. Directional drilling techniques are then used to deviate away from vertical to form a horizontal section 34, which is also part of the main bore 30. A window is then formed in the horizontal section 34 of the main bore, and the lateral wellbore 40 may then be drilled at a low-side exit 36 from the horizontal portion 38 of the main bore 30.

For ease of illustration, the low-side exit 36 is drawn facing vertically downward, and the horizontal section 34 is drawn at ninety degrees to the surface (perpendicular to gravitational force). However, a low-side exit may be any exit to a lateral bore along a non-vertical primary bore such that the ordinary weight of heavy tubing might cause a tubing string to veer out the low-side exit into the lateral bore.

Having drilled the multilateral wellbore 14 in the formation, portions of the wellbore may be completed by tripping tubular componentry downhole and installing it on the tubing string 20. For example, the tubing string 20 is shown in FIG. 1 being lowered into the main bore 30 from the surface 16 down to the horizontal section 34 of the main bore 30, with a tubular component 50 carried on the tubing string 20. The tubing string 20 and tubular component 50 may comprise tubing of heavy steel or other metallic materials. A buoyant guide sub 60 accordingly to this disclosure is positioned at a leading end 21 of the tubing string 20, ahead of the tubular component 50. The guide sub 60 is a buoyant member that is capable of floating in a well fluid. The buoyancy of the guide sub 60 may urge the guide sub 60 to a high side of the main bore above the low-side exit 36. The guide sub 60 may be used, as further discussed below, to traverse the low-side exit 36, and then to help guide the tubular component 50 or the tubing string 20 across the multilateral junction 35 to the downstream portion 38 of the main bore.

Figure 6:
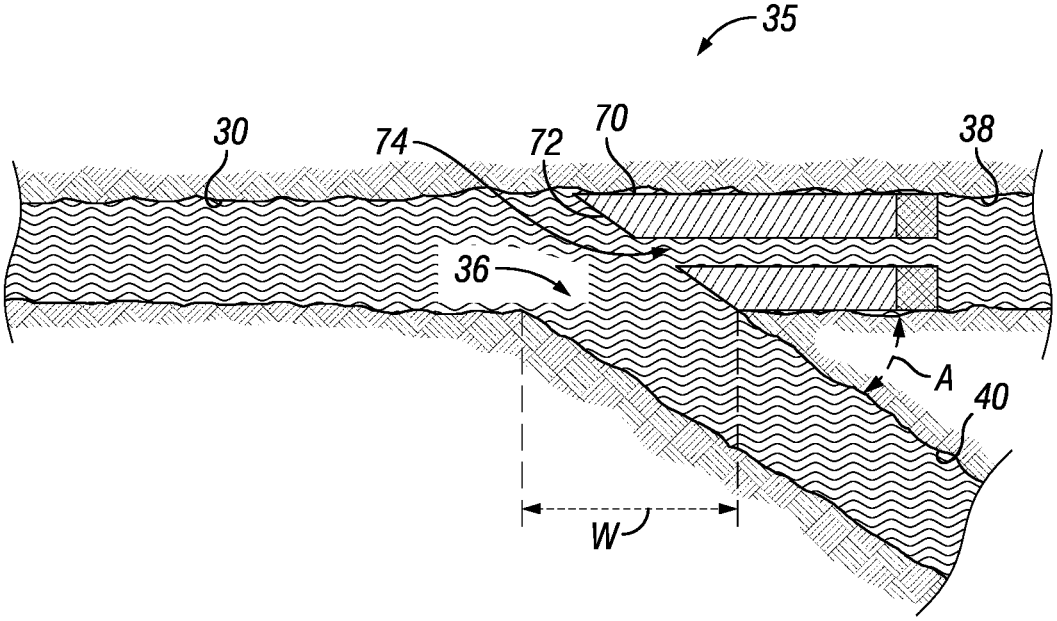
FIG. 6 is a side view of the multilateral junction as prepped for installation of a multilateral junction assembly.
Figure 7:
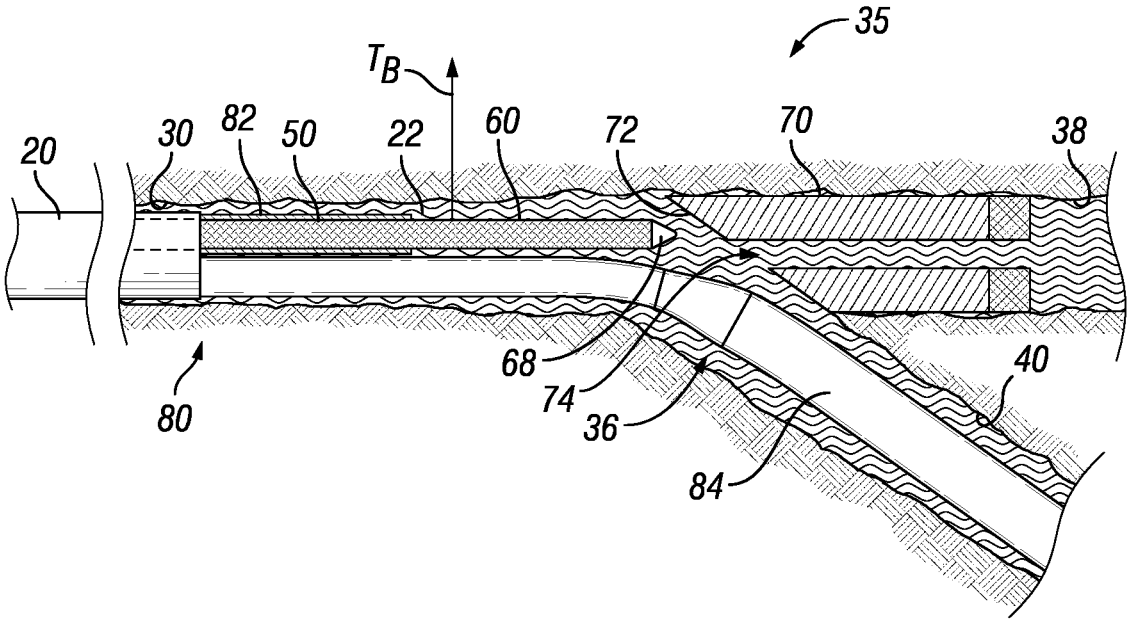
FIG. 7 is a schematic side view of the multilateral junction assembly being installed in the multilateral junction prepped as per FIG. 6.
Figure 8:
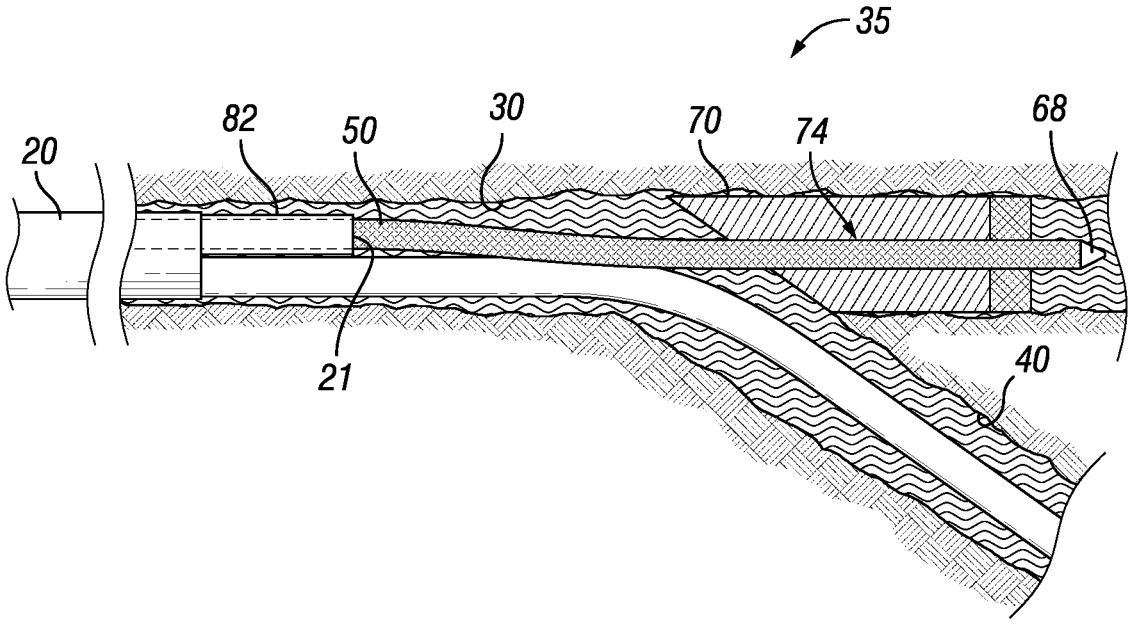
FIG. 8 is a schematic side view of the multilateral junction where the guide sub has traversed the low-side exit and entered the bore of the completion deflector.
Figure 9:
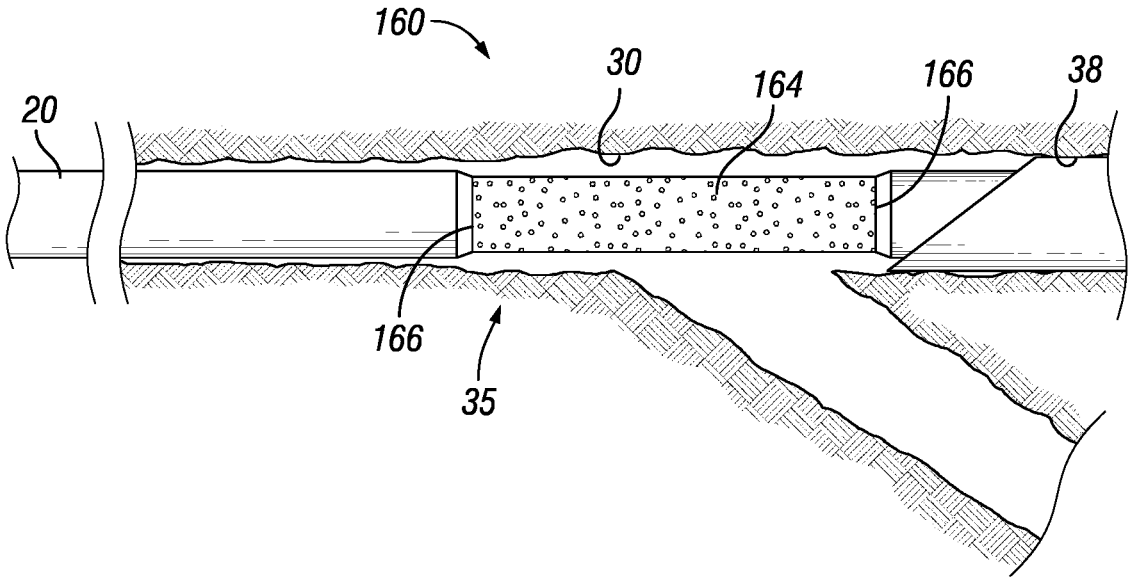
FIG. 9 is a schematic side view of another buoyant guide sub configuration embodied as a floating conduit for service work in the main bore downstream of the multilateral junction.

Aspects of this disclosure are useful in both installing the completions and later servicing the well upon completion. The tubing string 20 may be a completions string or a work string for installing or servicing the well. The tubular component 50 carried on the tubing string 20 may include tubular members for lining and reinforcing the main bore 30 and/or lateral bore 40. FIGS. 6-8, for example, provide an example of using a buoyant guide sub on a tubing string to install a multilateral junction assembly at the multilateral junction 35. FIG. 9 illustrates another example wherein the buoyant guide sub is a floating conduit for servicing the primary bore downstream of the multilateral junction 35.

Figure 2:
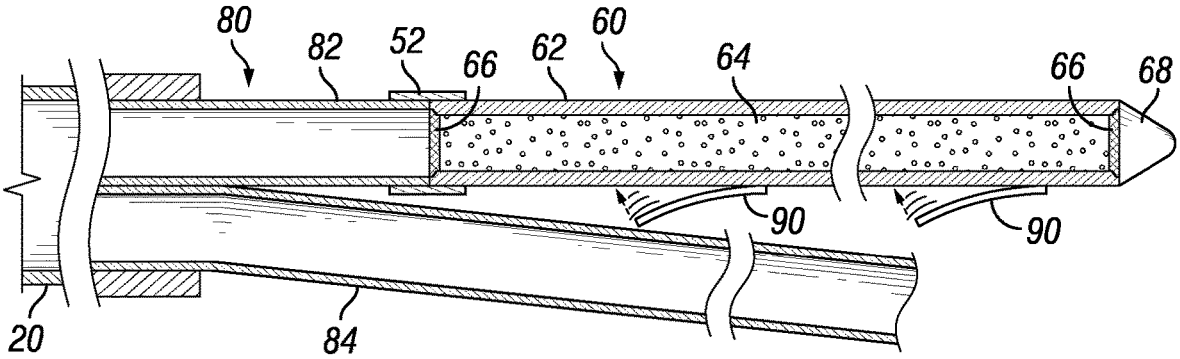
FIG. 2 is an example configuration of the buoyant guide sub coupled to a multilateral junction assembly at a leading end of the tubing string.

FIG. 2 is an example configuration of the buoyant guide sub 60 coupled to a multilateral junction assembly 80 at a leading end of the tubing string 20. The multilateral junction assembly 80 is for reinforcing a multilateral junction formed in an earthen formation. The multilateral junction assembly 80 includes a primary bore leg 82 configured for insertion into the primary bore of a multilateral junction, and a secondary bore leg 84 below the primary bore leg and configured for insertion into the lateral bore of the junction. The primary bore leg 82 and secondary bore leg 84 are generally tubular structures that may be run downhole together on the end of the tubing string 20. The weight and downwardly-angled profile of the secondary bore leg 84 allows the secondary bore leg 84 to be readily landed in the lateral bore. However, the buoyant guide sub 60 is provided to guide the primary bore leg 82 across the low-side exit to the downstream portion of the primary bore to avoid the primary bore leg 82 also veering down into the lateral bore.

The buoyant guide sub 60 in this example comprises a hollow tubular structure, with a tubular wall 62 formed of a low density material, such as fiberglass or carbon fiber. These materials are considerably lower density than most metallic materials used in conventional oilfield tubulars, and the lower density can therefore contribute to producing a relatively lightweight structure as compared with conventional oilfield tubulars. In at least some embodiments, the low density material used in the tubular wall 62 may have a specific gravity of less than 3, whereas most metallic materials used in conventional oilfield tubulars have a specific gravity greater than 7.5. The ends of the tubular wall are initially closed with end caps 66, to define a sealed tubular interior chamber filled with a gas 64. A nose 68 of the buoyant guide sub 60 may have a pointed, tapered, rounded, or otherwise contoured shape to help guide the buoyant guide sub 60 into position when landing in the bore of a completion deflector. The gas within the buoyant guide sub 60 may be pressurized at surface. Alternatively, one of the end caps 66 may be configured as a floating piston axially moveable within the tubular wall 62 may be used to pressurize the gas 64. The end caps 66 could optionally comprise plugs, burst discs, or a dissolvable or degradable material (discussed below), so that flow can be established through the interior of the tubular wall 62 of the buoyant guide sub 60 after traversing the multilateral junction.

In other embodiments, one or more components of the guide sub 60 may be formed of a dissolvable or degradable material to be disintegrated after traversing a multilateral junction, to allow passage of fluid or components across the junction. In one embodiment, the entire guide sub could be degraded after it has guided the tubing string or tubular component in the downstream portion of the main bore. In another example, just the end caps 66 dissolvable or degradable, so that flow can be established through the buoyant guide sub 60 after traversing the multilateral junction. In some configurations a dissolvable metal may be used, such as magnesium alloy or aluminum alloy. In other configurations, a degradable polymer may be used, such as an aliphatic polyester, a thermoplastic epoxy, or a urethane. These are lower density materials than most of the metallic materials used in tubing strings.

In another example, a degradable polymer can be compounded with hollow glass microspheres to further reduce the density. Glass microspheres can have a crush strength greater than the hydrostatic pressure. In one example, a buoyant guide sub 60 constructed from epoxy and glass microspheres may have a specific gravity less than 1 (i.e., would float in ordinary water) and degrade within 2 weeks in salt brine at 150 degrees Celsius. If faster dissolution is desired, then a fluid could be circulated to depth to aid the degradation, such as an acid.

The lightweight tubular structure filled with the gas 64 gives the buoyant guide sub 60 of FIG. 2 buoyancy. The gas 64 has a much lower density than any non-gaseous fluid (e.g., mud) that may be present in the multilateral well. The low density material of the sidewall, though heavier than compressed gas, is significantly lower density than metallic materials. The resulting construction of the buoyant guide sub 60 has a combined weight per volume that is lower than the specific gravity of the well fluid, and in most cases may be less than the specific gravity of water. The gas 64 may also be pressurized to counter the hydrostatic pressure downhole.

The buoyancy of the buoyant guide sub 60 may be proportional to the difference in the total weight per unit volume of the buoyant guide sub 60 and the weight per unit volume of the well fluid 22 in which it is submerged. The well fluid 22 may be, for example, a weighted fluid ("mud") used to balance pore pressure, a formation fluid, water, or combination thereof. A typical density of the well fluid 22 is equal to or greater than the density of water (i.e., the well fluid may have a specific gravity of greater than 1). Therefore, the guide sub should float in the well fluid so long as the weight per volume of the guide sub is no heavier than water. For a reliable safety margin and increased buoyancy, the buoyant guide sub 60 could be designed to have a buoyancy of less than the specific gravity of water.

The upward bias provided by the buoyancy of the buoyant guide sub 60 may be supplemented using any suitable mechanical spring. For example, one or more optional leaf springs 90 are secured to the buoyant guide sub 60 along the low side of the tubular wall 62. The leaf springs 90 may be angled and/or curved outwardly in a relaxed state, so they flex inwardly when they enter a bore, to bias the guide sub 60 upwardly.

Figure 3A:
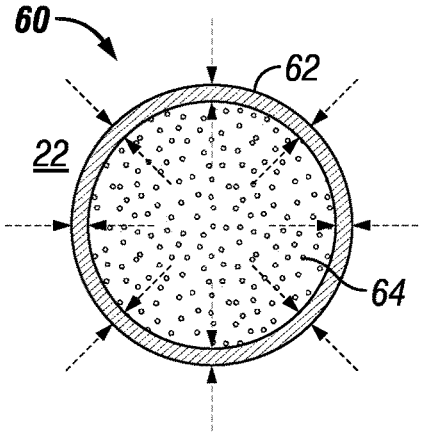
FIG. 3A is a cross-sectional view of the buoyant guide sub having a hollow tubular structure filled with a pressurized gas.
Figure 3B:
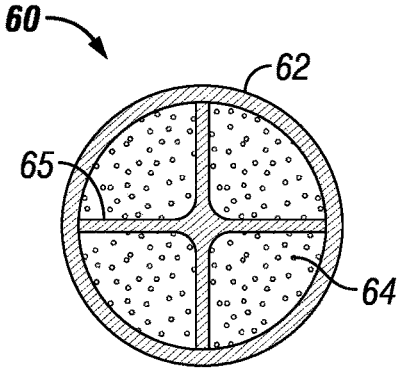
FIG. 3B is a cross-sectional view of an alternative example configuration, wherein the tubing is further reinforced by a rigid structural member.
Figure 3C:
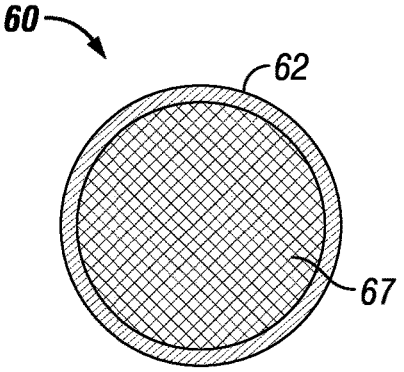
FIG. 3C is a cross-sectional view of yet another example configuration, wherein the composite tubing is filled with a solid, structural foam core.

FIGS. 3A-3C illustrate various alternative constructions of the buoyant guide sub 60 that provide stiffness and buoyancy. FIG. 3A is a cross-sectional view of the buoyant guide sub 60 having a hollow tubular structure filled with a pressurized gas. The tubing wall 62 of the buoyant guide sub 60 may be a lightweight composite material such as fiberglass or carbon fiber. Although a composite tube structure may have good stiffness along its length, it can be more vulnerable to compression such as from hydrostatic pressure of a well fluid. Therefore, the gas 64 sealed within the tubing may be pressurized to offset that hydrostatic pressure.

FIG. 3B is a cross-sectional view of an alternative example configuration, wherein the tubing is further reinforced by a rigid structural member. The rigid structural member comprises an internal web 65 that runs along the length of the buoyant guide sub 60 (into the page). The web 65 in this example has an X-shaped cross-section, but any other web shapes are within the scope of this disclosure that provide sufficient rigidity and buoyancy. The voids between the web 65 and the tubing wall 62 may be filled with the pressurized gas 64 to help offset hydrostatic pressure.

FIG. 3C is a cross-sectional view of yet another example configuration, wherein the composite tubing is filled with a solid, structural foam core 67 rather than a compressed gas. The foam may be open-cell or closed cell. In one embodiment, the closed cell foam is a syntactic foam. The foam may have a density high enough to offset hydrostatic pressure to prevent collapse of the tubing wall 62, and low enough to still provide buoyancy to the buoyant guide sub 60. The foam may also ensure the tubing wall remains a uniform diameter along its length so that oriented composite fibers remain in tension for a good stiffness-to-weight ratio.

Any of the example structures of FIGS. 3A-3C may be used for the buoyant guide sub 60 of FIG. 2. Referring again to FIG. 2, the buoyant guide sub 60 is coupled end-to-end with the primary bore leg 82 of the multilateral junction assembly with a coupler 52. The coupler 52 may comprise a sleeve with opposing ends that receive the buoyant guide sub 60 at one end and the tubing string 20 at the other end. The coupler 52 may comprise a threaded pin/box connection, a slip-fit connection, a threaded connection, an epoxied connection, or any other suitable connection for coupling tubular members end to end.

Figure 4:
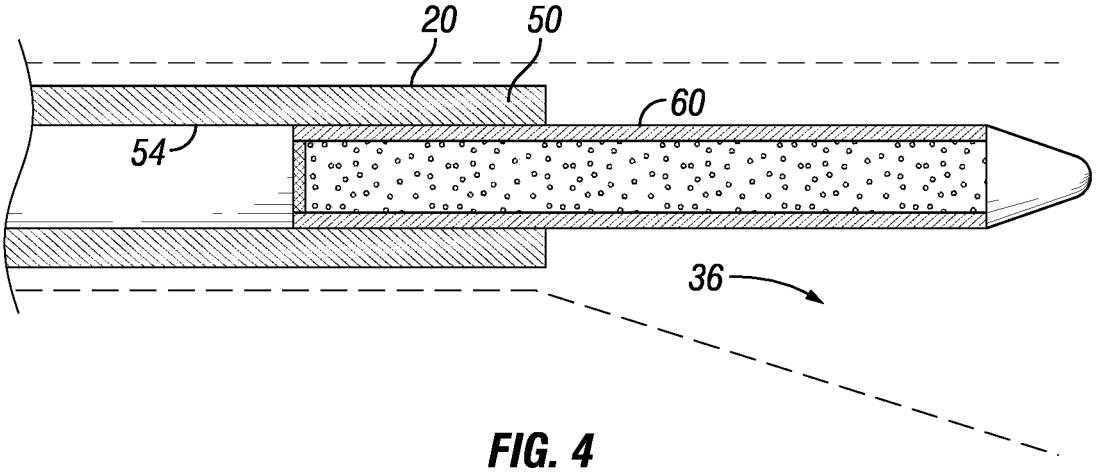
FIG. 4 is a schematic side view of an embodiment wherein the buoyant guide sub is slidably disposed inside an interior of the tubular component.

FIG. 4 is a schematic side view of an embodiment wherein the buoyant guide sub 60 is slidably disposed inside an interior 54 of the tubular component 50. The tubular component 50 may be the primary bore leg of the multilateral junction assembly (e.g., FIG. 2), for example. After the buoyant guide sub 60 has traversed the low-side exit 36, the tubing string 20 may be slid along the outside of the buoyant guide sub 60 to guide the tubular component 50 across the low-side exit.

Figure 5:
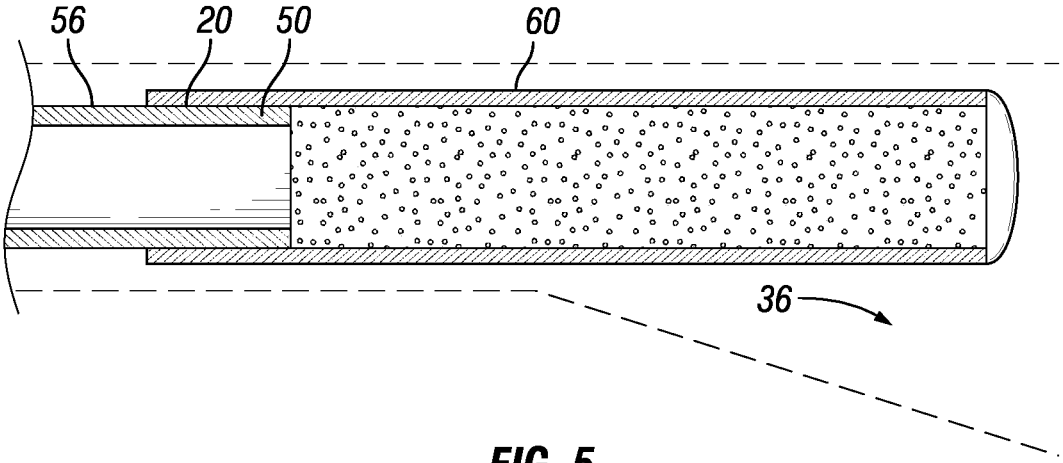
FIG. 5 is a schematic side view of an alternative embodiment wherein the buoyant guide sub is instead slidably disposed about an exterior of the tubular component.

FIG. 5 is a schematic side view of an alternative embodiment wherein the buoyant guide sub 60 is instead slidably disposed about an exterior 56 of the tubular component 50. After the buoyant guide sub 60 has traversed the low-side exit 36, the tubular component 50 of the tubing string 20 may slide along the inside of the buoyant guide sub 60 to guide the tubular component 50 across the low-side exit 36.

FIGS. 6 to 9 now illustrate examples of using a buoyant guide sub 60 to traverse a low-side exit 36 of a multilateral junction 35.

FIG. 6 is a side view of the multilateral junction 35 prepped for installation of a multilateral junction assembly. A lateral bore 40 has previously been formed intersecting the main bore 30, such as using a whipstock deflector for forming the low-side exit 36 and drilling the lateral bore 40. A completion deflector 70 is positioned along the main bore 30, which may be different than the deflector previously used to form the lateral bore 40. Alternatively, because this example is open-hole with a low-side exit, the whipstock deflector may be re-used. The completion deflector 70 may be used to help urge certain completion assemblies into the lateral bore 40 along the surface of a deflector 72, while still allowing the primary bore leg of a multilateral junction assembly (see FIG. 2) to be landed withing a narrow deflector bore 74 using the buoyant guide sub 60. The horizontal scale of FIG. 6 is compressed for ease of illustration, to exaggerate the angle "A" as drawn and narrow the width "W" for ease of discussion. In reality, the angle A may be only about 2 to 3 degrees, and the width of the low-side exit 36 may be tens of feet long (e.g., around 30 feet long).

FIG. 7 is a schematic side view of the multilateral junction assembly 80 of FIG. 2 being installed in the multilateral junction 35 prepped as per FIG. 6. The multilateral junction assembly is coupled to the primary bore leg 82 of the multilateral junction assembly using the general connection type of FIG. 4 (multilateral junction assembly internal to the tubular component). However, any suitable coupler configuration may be used such as the various alternatives described above. The multilateral junction assembly has reached a portion of the main bore 30 just upstream of the low-side exit. The buoyant guide sub 60 has partially traversed the low-side exit 36 on its way to the deflector bore 74. The secondary bore leg 84 of the multilateral junction assembly extends further forward than the primary bore leg 82 and has already entered the lateral bore 40. Meanwhile, the primary bore leg 82 remains supported by the main bore 30 uphole of the low-side exit 36.

The guide sub 60 may be at least as long as the width of the low-side exit 36, so that the buoyant guide sub 60 may float all the way across the exit 36 and enter the deflector bore 74 before any of the tubing string 20 has entered the portion of the main bore over the low-side exit. A shorter buoyant guide sub 60 may also work, but any non-buoyant portion of the tubing string 20 that passes over the low-side exit 36 before the buoyant guide sub 60 reaches the deflector bore 74 risks weighing down the buoyant guide sub 60 to counter the upward buoyancy provided by the buoyant guide sub 60.

FIG. 8 is a schematic side view of the multilateral junction 35 with the multilateral junction assembly advanced further down the main bore 30 to where the guide sub 60 has now traversed the low-side exit and entered the bore 74 of the completion deflector 70. The buoyant guide sub 60 may now support the primary bore leg 82 without letting it drop into the lateral bore 40. The buoyant guide sub 60 may be held stationary while the tubing string 20 is slid over the buoyant guide sub 60 to guide the tubing string 20 into the deflector bore 74. Once the primary bore leg 82 has been landed in the deflector bore 74, the buoyant guide sub 60 may be dissolved or degraded as described above. Alternatively, the ends of the buoyant guide sub 60 may be punctured, ruptured, drilled, dissolved, or otherwise removed to establish flow down the tubing string 20 to the downstream portion of the main bore.

FIG. 9 is a schematic side view of another buoyant guide sub configuration embodied as a floating conduit 160 for service work in the downstream portion 38 of the main bore 30. As with the buoyant guide sub 60 of prior embodiments, the floating conduit 160 may have a lightweight tubular wall 162, initially sealed with a rupturable or drillable disc 166 at each end, and a pressurized gas 164. The floating conduit 160 may have a wider diameter as compared with the version of the buoyant guide sub 60 in preceding embodiments to improve volumetric flow through. A service operation may comprise flowing a working fluid from the tubing string 20 through the guide sub 160 into the downstream portion 38 of the main bore. The service operation may comprise any of a variety of service operations that involve transmission of a working fluid. For instance, in an example of a formation stimulation operation, proppant-laden fluids used in hydraulically fracturing the formation, or other treatment fluids and/or chemicals such as an acidizing treatment, may be circulated downhole through the floating conduit 160, such as through a hydraulic fracturing tubing string (i.e. frac tubing string) to stimulate the flow of hydrocarbons from the formation. In an example of a production operation, production tubing may be lowered into the wellbore and coupled to the floating conduit 160 above a production zone, so formation fluids such as oil and gas may be produced to surface.

Accordingly, the present disclosure provides various systems and methods for traversing a low-side exit multilateral junction using a tubular guide sub to bias the tubular towards the high-side of the junction when traversing the low-side exit. The methods, systems, compositions, and tools may include any of the various features disclosed herein, including one or more of the following statements.

Statement 1. A method, comprising: advancing a tubing string along a primary wellbore toward a junction having a low-side exit to a secondary wellbore, with a guide sub positioned at a leading end of the tubing string, the guide sub having a buoyancy within a well fluid external to the guide sub; using the buoyancy of the guide sub to bias the guide sub toward a high-side of the primary wellbore while moving the guide sub across the low-side exit to a downstream portion of the primary wellbore; and subsequently using the guide sub to guide a fluid or tubular component between the tubing string and the downstream portion of the primary wellbore across the low-side exit.

Statement 2. The method of Statement 1, further comprising: generating the buoyancy using a tubular chamber filled with a gas; and pressurizing the gas to offset a hydrostatic pressure external to the guide sub.

Statement 3. The method of Statement 1 or 2, further comprising: severing an end wall of the guide sub after moving the guide sub across the low-side exit, to provide through-tube access for the fluid or tubular component across the low-side exit.

Statement 4. The method of any of Statements 1-3, further comprising: supplementing the buoyancy of the guide sub by urging the guide sub upwardly using a mechanical spring on a low side of the guide sub.

Statement 5. The method of any of Statements 1-4, wherein the tubular component comprises a tubular leg of a multi-bore junction assembly, and the guide sub guides the tubular leg across the low-side exit into the bore of a completion deflector.

Statement 6. The method of any of Statements 1-5, wherein the guide sub is configured to guide the tubular component across the low-side exit through an interior of the buoyant guide sub.

Statement 7. The method of any of Statements 1-6, wherein the guide sub is configured to guide the tubular component across the low-side exit along an exterior of the buoyant guide sub.

Statement 8. The method of any of Statements 1-7, further comprising: dissolving at least a portion of the guide sub before guiding the fluid or tubular component across the low-side exit.

Statement 9. The method of any of Statements 1-8, further comprising: performing a service operation in the downstream portion of the primary wellbore, the service operation comprising flowing a working fluid from the tubing string and through the guide sub into the downstream portion of the primary wellbore.

Statement 10. A system for traversing a multilateral junction having a low-side exit from a primary wellbore to a secondary wellbore, the system comprising: a tubular string for lowering from a surface of a wellsite into the primary wellbore of the multilateral well toward the multilateral junction; and a guide sub coupled to the tubular string, the guide sub having a buoyancy to bias the guide sub toward a high side of the primary wellbore when traversing the low-side exit; and wherein the guide sub is configured for guiding a fluid or a tubular component of the tubular string across the low side exit after the guide sub has traversed the low-side exit.

Statement 11. The system of Statement 10, wherein the guide sub comprises an elongate composite tube having a specific gravity of less than 3, the elongate composite tube enclosing a pressurized gas to offset hydrostatic pressure.

Statement 12. The system of any of Statements 10-11, wherein ends of the elongate tube are severable by dissolving, drilling, or pressure bursting after the guide sub has traversed the low-side exit to provide through-tube access for the fluid or the tubular component.

Statement 13. The system of any of Statements 10-12, wherein the buoyant guide sub has a length spanning the low-side exit of the multilateral junction.

Statement 14. The system of any of Statements 10-13, wherein the tubular component to be guided by the guide sub across the low-side exit comprises a tubular leg of a multi-bore junction assembly.

Statement 15. The system of Statement 14, further comprising: a completion deflector landed in the downstream portion of the primary wellbore, the completion deflector comprising a deflector surface and a bore through the deflector surface sized for receiving the guide sub followed by the tubular leg of the multi-bore junction assembly.

Statement 16. The system of any of Statements 10-14, wherein at least a portion of the guide sub is formed of a degradable or dissolvable material.

Statement 17. The system of any of Statements 10-16, wherein the guide sub comprises a degradable polymer having a specific gravity of less than 1 compounded with hollow glass microspheres having a crush strength greater than the hydrostatic pressure, wherein the degradable polymer is degradable within 2 weeks in salt brine at 150 degrees Celsius.

Statement 18. The system of any of Statements 10-17, wherein the guide sub further comprises a rigid internal web reinforcing a composite outer tubular structure.

Statement 19. The system of any of Statements 10-18, further comprising:a mechanical spring secured to the buoyant guide sub to bias the guide sub upwardly against the primary wellbore.

Statement 20. A method for completing a multilateral junction, comprising: securing a tubular completion component to a tubing string, the tubular completion component including a primary bore leg and a secondary bore leg; securing a buoyant guide sub to the primary bore leg of the tubular completion tool, the buoyant guide sub having a weight per volume of less than a downhole fluid in the vicinity of the multilateral junction; and lowering the tubing string, with the tubular completion tool and the guide sub, into a multilateral well to a multilateral junction having a low-side exit to a secondary wellbore; moving the secondary bore leg into the secondary wellbore; moving the guide sub across the low-side exit and into a downstream portion of the primary wellbore while using the buoyancy of the guide sub to bias the guide sub toward a high-side of the primary wellbore; and using the guide sub to guide the primary bore leg across the low-side exit and into the primary bore.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A method, comprising:

advancing a tubing string along a primary wellbore toward a junction having a low-side exit to a secondary wellbore, with a guide sub positioned at a leading end of the tubing string, the guide sub having a buoyancy within a well fluid external to the guide sub;

using the buoyancy of the guide sub to bias the guide sub toward a high-side of the primary wellbore while moving the guide sub across the low-side exit to a downstream portion of the primary wellbore;

subsequently using the guide sub to guide a fluid or a tubular component of the tubing string to the downstream portion of the primary wellbore across the low-side exit; and severing an end wall of the guide sub after moving the guide sub across the low-side exit, to provide through-tube access for the fluid or the tubular component across the low-side exit.

2. The method of claim 1, further comprising:

generating the buoyancy using a tubular chamber filled with a gas; and pressurizing the gas to offset a hydrostatic pressure external to the guide sub.

3. The method of claim 1, further comprising:

supplementing the buoyancy of the guide sub by urging the guide sub upwardly using a mechanical spring on a low side of the guide sub.

4. The method of claim 1, further comprising:

performing a service operation in the downstream portion of the primary wellbore, the service operation comprising flowing a working fluid from the tubing string and through the guide sub into the downstream portion of the primary wellbore.

5. A method, comprising:

advancing a tubing string along a primary wellbore toward a junction having a low-side exit to a secondary wellbore, with a guide sub positioned at a leading end of the tubing string, the guide sub having a buoyancy within a well fluid external to the guide sub;

using the buoyancy of the guide sub to bias the guide sub toward a high-side of the primary wellbore while moving the guide sub across the low-side exit to a downstream portion of the primary wellbore;

subsequently using the guide sub to guide a fluid or a tubular component of the tubing string to the downstream portion of the primary wellbore across the low-side exit, wherein the tubular component comprises a tubular leg of a multi-bore junction assembly, and the guide sub guides the tubular leg across the low-side exit into a bore of a completion deflector.

6. A method, comprising:

advancing a tubing string along a primary wellbore toward a junction having a low-side exit to a secondary wellbore, with a guide sub positioned at a leading end of the tubing string, the guide sub having a buoyancy within a well fluid external to the guide sub;

using the buoyancy of the guide sub to bias the guide sub toward a high-side of the primary wellbore while moving the guide sub across the low-side exit to a downstream portion of the primary wellbore;

subsequently using the guide sub to guide a fluid or a tubular component of the tubing string to the downstream portion of the primary wellbore across the low-side exit, wherein the guide sub is configured to guide the tubular component across the low-side exit through an interior of the buoyant guide sub.

7. A method, comprising:

advancing a tubing string along a primary wellbore toward a junction having a low-side exit to a secondary wellbore, with a guide sub positioned at a leading end of the tubing string, the guide sub having a buoyancy within a well fluid external to the guide sub;

using the buoyancy of the guide sub to bias the guide sub toward a high-side of the primary wellbore while moving the guide sub across the low-side exit to a downstream portion of the primary wellbore;

subsequently using the guide sub to guide a fluid or a tubular component of the tubing string to the downstream portion of the primary wellbore across the low-side exit, wherein the guide sub is configured to guide the tubular component across the low-side exit along an exterior of the buoyant guide sub.

8. A method comprising:

advancing a tubing string along a primary wellbore toward a junction having a low-side exit to a secondary wellbore, with a guide sub positioned at a leading end of the tubing string, the guide sub having a buoyancy within a well fluid external to the guide sub;

using the buoyancy of the guide sub to bias the guide sub toward a high-side of the primary wellbore while moving the guide sub across the low-side exit to a downstream portion of the primary wellbore;

subsequently using the guide sub to guide a fluid or a tubular component of the tubing string to the downstream portion of the primary wellbore across the low-side exit; and dissolving at least a portion of the guide sub before guiding the fluid or tubular component across the low-side exit.

9. A system for traversing a multilateral junction having a low-side exit from a primary wellbore to a secondary wellbore, the system comprising:

a tubular string for lowering from a surface of a wellsite into the primary wellbore of the multilateral well toward the multilateral junction; and a guide sub coupled to the tubular string, the guide sub having a buoyancy to bias the guide sub toward a high side of the primary wellbore when traversing the low-side exit; and wherein the guide sub is configured for guiding a fluid or a tubular component of the tubular string across the low side exit after the guide sub has traversed the low-side exit, wherein the tubular component to be guided by the guide sub across the low-side exit comprises a tubular leg of a multi-bore junction assembly.

10. The system of claim 9, wherein the guide sub comprises an elongate composite tube having a specific gravity of less than 3, the elongate composite tube enclosing a pressurized gas to offset the hydrostatic pressure.

11. The system of claim 10, wherein ends of the elongate tube are severable by dissolving, drilling, or pressure bursting after the guide sub has traversed the low-side exit to provide through-tube access for the fluid or the tubular component.

12. The system of claim 9, wherein the buoyant guide sub has a length spanning the low-side exit of the multilateral junction.

13. The system of claim 9, further comprising:

a completion deflector landed in the downstream portion of the primary wellbore, the completion deflector comprising a deflector surface and a bore through the deflector surface sized for receiving the guide sub followed by the tubular leg of the multi-bore junction assembly.

14. The system of claim 9, wherein at least a portion of the guide sub is formed of a degradable or dissolvable material.

15. The system of claim 9, further comprising:

a mechanical spring secured to the buoyant guide sub to bias the guide sub upwardly against the primary wellbore.

16. A system for traversing a multilateral junction having a low-side exit from a primary wellbore to a secondary wellbore, the system comprising:

a tubular string for lowering from a surface of a wellsite into the primary wellbore of the multilateral well toward the multilateral junction; and a guide sub coupled to the tubular string, the guide sub having a buoyancy to bias the guide sub toward a high side of the primary wellbore when traversing the low-side exit; and wherein the guide sub is configured for guiding a fluid or a tubular component of the tubular string across the low side exit after the guide sub has traversed the low-side exit; and wherein the guide sub comprises a degradable polymer having a specific gravity of less than 1 compounded with hollow glass microspheres having a crush strength greater than a hydrostatic pressure, wherein the degradable polymer is degradable within 2 weeks in salt brine at 150 degrees Celsius.

17. A system for traversing a multilateral junction having a low-side exit from a primary wellbore to a secondary wellbore, the system comprising:

a tubular string for lowering from a surface of a wellsite into the primary wellbore of the multilateral well toward the multilateral junction; and a guide sub coupled to the tubular string, the guide sub having a buoyancy to bias the guide sub toward a high side of the primary wellbore when traversing the low-side exit; and wherein the guide sub is configured for guiding a fluid or a tubular component of the tubular string across the low side exit after the guide sub has traversed the low-side exit; and wherein the guide sub further comprises a rigid internal web reinforcing a composite outer tubular structure.

18. A method for completing a multilateral junction, comprising:

securing a tubular completion component to a tubing string, the tubular completion component including a primary bore leg and a secondary bore leg;

securing a buoyant guide sub to the primary bore leg of the tubular completion component, the buoyant guide sub having a weight per volume of less than a downhole fluid in a vicinity of the multilateral junction; and lowering the tubing string, with the tubular completion component and the guide sub, into a multilateral well to the multilateral junction having a primary wellbore and a low-side exit to a secondary wellbore;

moving the secondary bore leg into the secondary wellbore;

moving the guide sub across the low-side exit and into a downstream portion of the primary wellbore while using the buoyancy of the guide sub to bias the guide sub toward a high-side of the primary wellbore; and using the guide sub to guide the primary bore leg across the low-side exit and into the primary wellbore.

* * * * *